United States Patent [19]

Brückner et al.

[11] Patent Number: 4,833,845

[45] Date of Patent: May 30, 1989

[54] SELF-SUPPORTING COMPOSITE PLATE, ESPECIALLY DOUBLE FLOOR PLATE

[75] Inventors: Günther Brückner, Abtswind; Wolfgang Hiller, Karlstadt-Laudenbach; Ulrich Klingelhöfer, Waldbüttelbrunn; Manfred Radtke, Margetshöchheim, all of Fed. Rep. of Germany

[73] Assignee: Mero-Werke Dr. Ing. Max Mengeringhausen GmbH & Co., Wurzburg, Fed. Rep. of Germany

[21] Appl. No.: 84,150

[22] Filed: Aug. 12, 1987

[30] Foreign Application Priority Data

Aug. 12, 1986 [DE] Fed. Rep. of Germany ..... 3627353

[51] Int. Cl.[4] ..... E04B 5/58

[52] U.S. Cl. ..... 52/126.6; 52/263; 52/630

[58] Field of Search ..... 52/126.6, 263, 630, 52/309.1

[56] References Cited

U.S. PATENT DOCUMENTS 4,621,468 11/1986 Likozar ..... 52/126.6

FOREIGN PATENT DOCUMENTS 2004101 11/1971 Fed. Rep. of Germany .

1475402 2/1967 France ..... 52/126.6

*Primary Examiner*—James L. Ridgill, Jr.

*Attorney, Agent, or Firm*—Frank P. Presta

[57] ABSTRACT

A shallow pan, preferably of tin-coated sheet steel, serves for the production of a self-supporting composite plate, wherein the pan forms the outside wrapper for a filler with high compression resistance, e.g., anhydrite. The pan contains a plurality of punches which provide anchoring with the filler material. To increase the bearing strength of the composite plate, the pan bottom is made up of four intersecting, shallow, bulged-out zones. These zones engage in the middle on a smooth, plate-like elevation and extend each in turn from deep areas along the intersecting symmetry axes of the pan toward the highest areas at each pan corner. The density of the punches in the pan bottom preferably increases from the inside toward the outside.

7 Claims, 2 Drawing Sheets

SELF-SUPPORTING COMPOSITE PLATE, ESPECIALLY DOUBLE FLOOR PLATE

BACKGROUND OF THE INVENTION

The present invention relates to a self-supporting composite plate, especially a double floor plate with rectangular section and a shallow pan, preferably of sheet metal, serving as an outside wrapper for a material, e.g. anhydrite, with high compression resistance, filled into the pan in a flowable or chargeable state and hardened therein, in which at least the pan bottom is provided with a plurality of punches producing the connection (anchoring) with the filler material, and the pan bottom is also profiled.

A self-supporting composite plate of the above type, of which the outside pan-shaped wrapper also has a smooth bottom, is known from German Pat. No. 2,004,101. Other further developments of this composite plate are also already known (see for comparison the prospectus of the MERO-Werke Company "MERO-Doppelboden" D 488 2/79), in which the floor, with a sheet metal pan serving as the outside wrapper, has reinforcements running from the middle outward, which pass over into a surrounding reinforcement in the border area of the pan bottom. With this composite plate type one also has the pan bottom bulging out from the outside edges to the middle of the bottom. This means that the filler, e.g. anhydrite, is thinnest in the middle of the plate, and is thickest in the area of the four outside edges of the composite plate. It has been shown that, especially when it is used for double floors, the bearing strength and carrying capacity of this composite plate construction is relatively limited and it is not suitable for high stresses. Such double floor plates are mainly known only mounted on uprights located only at their corners, and with very high charges, especially paint charges, critical points are located actually in the middle of the four outside edges of the bottom plate. The use of a stronger sheet metal material for the outside pan-shaped wrapper and/or an increase of the plate thickness cannot be used for various reasons.

SUMMARY OF THE INVENTION

A primary object of the present invention is to provide a self-supporting composite plate, especially a double floor plate, with higher bearing strength in comparison with the state of the art, while still retaining the plate height and material thickness used until this time for the pan-like outside wrapper.

According to the invention, the above object is attained with a self-supporting composite plate of the aforementioned structural type in that the pan bottom has four shallow bulged-out zones in an essentially cross-like configuration, which extend in turn from deep areas in the middle of the bottom and along the cross-like symmetry axes of the pan toward a highest area in each corner of the pan. As a result of this special profiling of the bottom of the pan forming the outside wrapper for the filler, especially in the critical four border areas of the composite plate, such sectional profiles are advantageously produced in the hardened filler material that the bearing strength of such a self-supporting composite plate is up to 50% higher in comparison to the aforementioned and described state of the art, and actually with practically identical plate weight. The pan with its bottom profiled according to the invention can be produced commercially by deep drawing sheet metal. However, it is also possible to construct the pan of a plastic material of great break and tensile strength. It is important that in any case, at least in the pan bottom, punches or the like are provided in sufficient number to guarantee the required connection between the pan material and the hardened filler.

Different configurations of the invention are set forth in the dependent claims. For example, it is advantageous if the vertex lines of the four bulged-out zones rising outwardly toward the pan corners coincide with the diagonals of the pan.

When in another configuration of the invention a smooth, plate-like elevation is provided in the middle of the bottom of the pan, its height, measured from the deep areas of the bottom of the pan along the symmetry axes of the pan, is only a fraction of the full height of the bottom of the pan in the areas of the corners of the pan, an undesirable snap effect arising from stresses in the bottom of the pan is avoided, which could be produced by deformation of the four shallow bulged-out zones.

According to still another configuration of the invention, the full height of the bulged-out pan bottom in the areas in the corners of the pan is one-fifth (1/5) to one-fourth ($\frac{1}{4}$) the structural height of the pan. The degree of deformation of the bottom of the pan is thus advantageously relatively small. This is favorable not only for its production, but also relative to the material thickness of the bottom of the pan following the deformation process.

In still another configuration of the invention, in the border area of the bottom of the pan near the side walls of the pan a surrounding reinforcement depression with a smooth bottom is formed therein in a known manner, of which the flat plane runs somewhat beneath the deepest areas between the four bulged-out zones of the pan bottom, and a contact of the profiled pan bottom inside the surrounding reinforcement depression with a subsoil or the like during laying of the composite plate thereon, for instance during the positioning or during the assembly of the composite plate, is advantageously avoided.

BRIEF DESCRIPTION OF THE DRAWINGS

The invention is to be described hereinafter relative to the drawings of one exemplary embodiment. They show.

DESCRIPTION OF THE PREFERRED EMBODIMENTS

Figure 1:
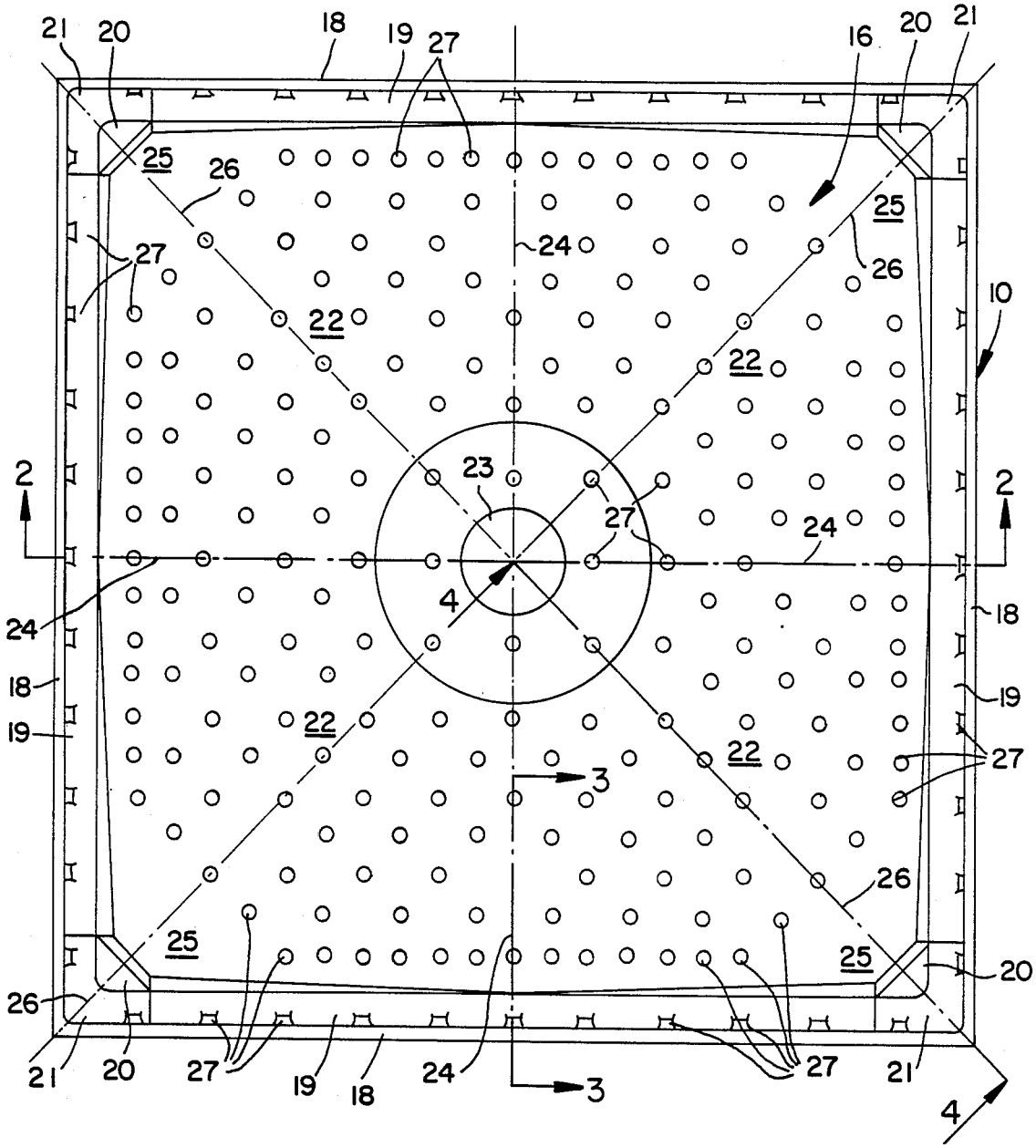
FIG. 1, a plan view of a flat structured sheet steel pan, which in the production of a self-supporting composite plate serves as outside wrapper for a filler of high compression resistance, e.g. anhydrite, and has the bottom thereof profiled according to the invention.

The pan (10) selected as an exemplary embodiment is formed of deepdrawn sheet steel which is tin-coated on both sides and forms the outside wrapper for a filler material (11), preferably anhydrite, provided in a flowable state and hardened in pan (10), in order to produce a double floor plate (12) (FIG. 5) with quadratic section. These double floor plates (12) have a floor covering (13) and are mounted with their corners on foundation uprights (14) so that the outside edges of the double floor plates (12) are in contact. Foundation uprights (14) are in turn mounted on a subsoil (15). As hereinbefore mentioned, the pan (10) may also be formed of a plastic material.

Sheet steel pan (10) may have a side length of about 600 mm and is of relatively flat construction with a structural height of about 33 mm.

Sheet steel pan (10) has a specially profiled bottom (16) to increase the bearing strength and load capacity of double floor plate (12), from which the four side walls (17) extend upwardly. The top edge of the side walls (17) is configured as a flange (18) bent outwardly.

Figure 5:
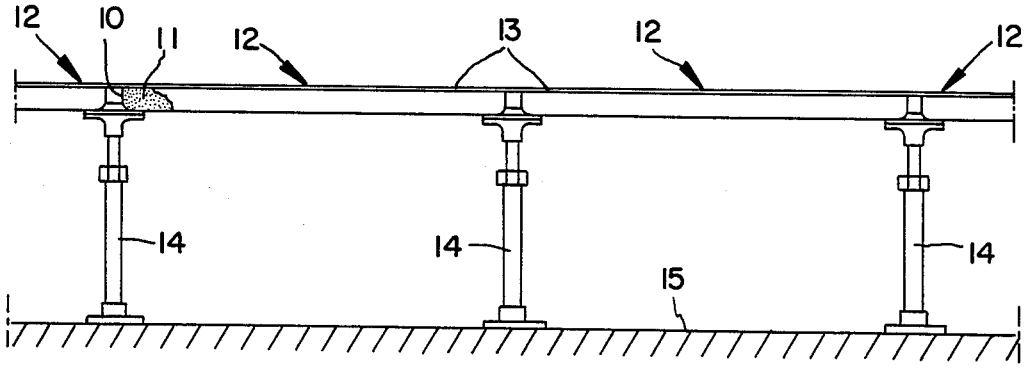
FIG. 5 is a side elevational view of a plurality of self-supporting composite plates in assembled state, which include the sheet steel pan shown in FIGS. 1 to 4 and form a double floor.
Figure 2:
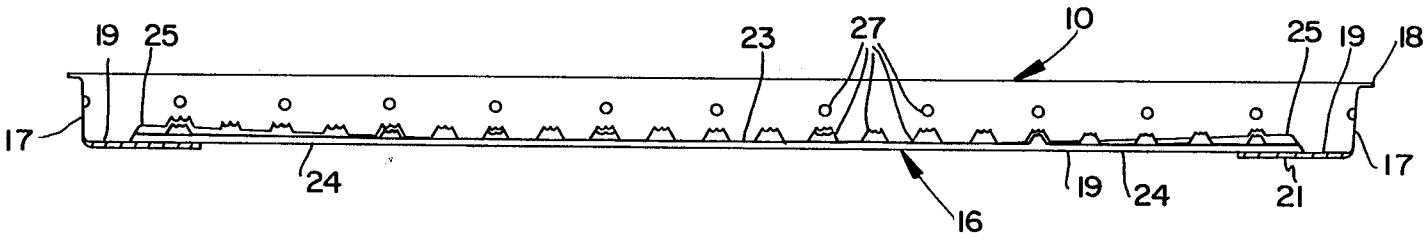
FIG. 2 is a cross sectional view taken substantially along line II—II of FIG. 1 and rotated through an angle of 90° from FIG. 1.
Figure 3:
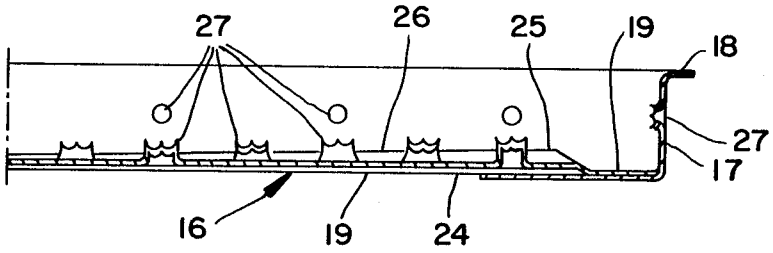
FIG. 3 is a cross sectional view taken substantially along line III—III of FIG. 1 and rotated through an angle of 180° from FIG. 1 in larger scale.
Figure 4:
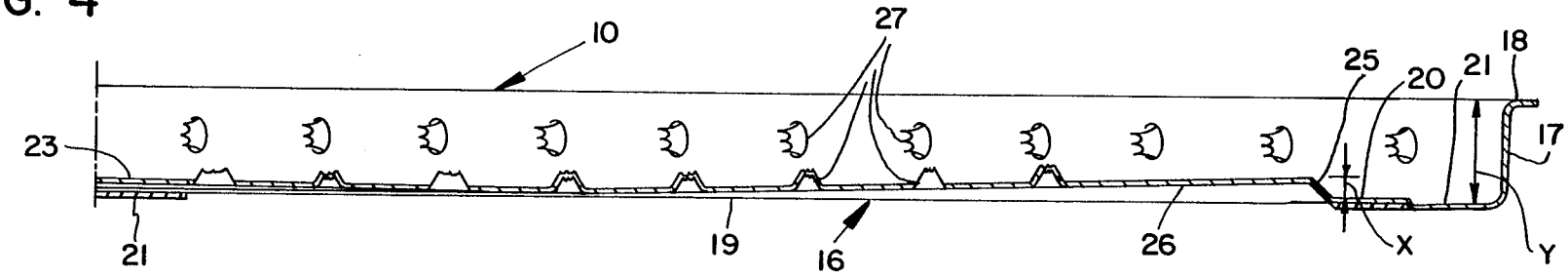
FIG. 4 is a cross sectional view taken substantially along line IV—IV of FIG. 1 in larger scale and rotated through an angle of 135° degrees from FIG. 1.

The edge area of pan bottom (16) includes a uniformly deep and wide surrounding reinforcement depression (19) with a flat bottom. Only at the four corners of pan (10) is depression (19) widened inwardly at (20) and provided with a smooth angled recess (21), with which pan (10) is mounted on foundation uprights (14) (FIG. 5). Within this surrounding reinforcement depression (19), pan bottom (16) is provided with four shallow bulged-out zones (22) and a smooth, plate-like elevation (23) in the middle of the bottom. The four bulged-out bottom zones (22) are arranged symmetrically so that they each extend in turn from deep areas along the intersecting symmetry axes (24) of pan (10) and from the smooth plate-like elevation (23) in the middle of the bottom of the pan toward a highest area (25) in each pan corner, wherein the vertex lines (26) of the bulged-out zones (22) rising outwardly toward the corners of the pan coincide with the diagonals of pan (10). Especially FIG. 4 shows that the height of the plate-like middle elevation (23) is only approximately half the total height of pan bottom (16) in the areas (25) near the pan corners. The same drawing also shows that the total height x of pan bottom (16) in areas (25) makes up only approximately one-fifth (1/5) to one-fourth ($\frac{1}{4}$) of the total structural height y of pan (10). Filler (11), preferably anhydrite, fed into pan (10) and hardened therein, with the aforementioned and described profiling of pan bottom (16) has a shaped profile, especially near the edges of pan (10), which quite noticeably increases the bearing strength and chargeability or load capacity of the completed composite plate (12) in comparison with similar constructions used until this time.

A plurality of punches (27) are worked into side walls (17) and pan bottom (16) to obtain the required connection between sheet steel pan (10) and the hardened filler (11). Openings are located below these punches (27), which are placed there by means of punches punching out through pan bottom (16) and/or side walls (17) so that inwardly projecting, frayed edges are formed and are embedded in the filler (11), and filler also penetrates into the openings of punches (27). So that filler (11) does not flow out through the openings in punches (27) while in its flowable filling state, these may be closed off by films adhering to outsides of the side walls (17) and pan bottom (16). The distribution of punches (27) in pan bottom (16) is also important for the high bearing strength and chargeability or load capacity of the completed double floor plate (12). In the middle of the pan bottom in the area of plate-like elevation (23) the density or closeness of the punches (27) is lowest, while at the edges of pan bottom (16) their concentration or density is greatest, (opposite to the surrounding reinforcement depression (19) and side walls (17)). Here in turn a series of closely adjacent punches (27) is provided.

It is also possible, in one modification of the exemplary embodiment, to arrange several rows of closely adjacent punches (27) parallel to each other. It is important that the density of punches (27) increase from the middle of the pan bottom outwardly. Punches (27) could furthermore be arranged in uniform or nonuniform distribution in pan bottom (16).

Although the preferred filler (11) is anhydrite, other flowable or chargeable and hardenable materials could be used, for instance concrete. It is critical that these fillers have the required high compression resistance in hardened state and provide the necessary connection with the pan material.

We claim:

1. Self-supporting composite plate, especially a double floor plate, with a shallow pan serving as an outside wrapper for a material with high compression resistance, filled into the pan in a flowable state and hardened therein, wherein at least the pan bottom is provided with a plurality of punches producing a connection with the filler material and the pan bottom is also profiled, characterized in that the pan bottom (16) is made up of shallow bulged-out zones (22) arranged essentially intersecting in cross shape, which extend substantially continuously upwardly in turn from deep areas in the middle of the bottom (23) along the intersecting symmetry axes (24) of the pan (10) to a highest area (25) in each corner of the pan.

2. Composite plate as in claim 1, characterized in that the vertex lines (26) of the four bulged-out zones (22) coincide with the diagonals of the pan (10).

3. Composite plate as in claim 1, characterized in that a smooth plate-like elevation (23) is provided in the middle of the bottom of the pan, of which the height measured from the deep areas of the pan bottom (16) along the symmetry axes (24) of the pan (10) is only a fraction of the total height of the pan bottom (16) in the areas (25) in the corners of the pan.

4. Composite plate as in claim 1, characterized in that the greatest height (x) of the bulged-out pan bottom (16) in the areas (25) in the corners of the pan is one-fifth to one-fourth the structural height (x) of the pan (10).

5. Composite plate as in claim 1, characterized in that a surrounding reinforcement depression (19) with a smooth bottom is molded into the border area of the pan bottom (16) adjacent to the side walls (17) of the pan (10), of which the plane runs somewhat beneath the deepest areas (24) between the four bulged-out zones (22) of the pan bottom (16).

6. Composite plate as in claim 1, characterized in that the shallow pan is formed of sheet metal.

7. Composite plate as in claim 1, characterized in that the shallow pan is formed of a plastic material.

* * * * *

UNITED STATES PATENT AND TRADEMARK OFFICE

CERTIFICATE OF CORRECTION

PATENT NO. : 4,833,845

DATED : May 30, 1989

INVENTOR(S) : Brückner et al

It is certified that error appears in the above-identified patent and that said Letters Patent is hereby corrected as shown below:

Column 4, line 37, after "in", insert --a--.

Column 4, line 55, delete "(x)" and insert --(y)--.

Signed and Sealed this

Twenty-third Day of January, 1990

*Attest:*

JEFFREY M. SAMUELS

*Attesting Officer*

*Acting Commissioner of Patents and Trademarks*